342-568 S2
PFR23 X2 4,673,915

United States Patent [19]

Cobb

[11] Patent Number: 4,673,915

[45] Date of Patent: Jun. 16, 1987

[54] KEY STORAGE AND MONITORING SYSTEM

[76] Inventor: Richard G. Cobb, 605 South First, Apt. #1, Norfolk, Nebr. 68701

[21] Appl. No.: 808,085

[22] Filed: Dec. 12, 1985

[51] Int. Cl.[4] ..... G08B 5/00; G08B 5/22

[52] U.S. Cl. ..... 340/330; 116/325

[58] Field of Search ..... 340/825.49, 825.35, 340/286 M, 332, 815.12, 330; 116/316–318, 325

[56] References Cited

U.S. PATENT DOCUMENTS

| | | | |
|---|---|---|---|
| 2,554,223 | 5/1951 | Szabo | 340/330 |
| 3,477,404 | 11/1969 | Robinson | 116/378 |
| 3,641,321 | 2/1972 | Tonne | 340/330 |
| 3,645,227 | 2/1972 | Lahmer | 116/325 |
| 4,595,922 | 6/1986 | Cobb et al. | 340/825.49 |

*Primary Examiner*—Donald J. Yusko
*Attorney, Agent, or Firm*—Kokjer, Kircher, Bradley, Wharton, Bowman & Johnson

[57] ABSTRACT

A storage board for keys and other articles which keeps track of missing keys by assigning user codes to authorized users and making provision for the entry of a code when a key is removed. In one embodiment, the keys are stored on pegs mounted to rotate with dials which are turned to enter the user codes. Each key is stored on its peg in a spiral groove which retains the key against removal unless the dial is first rotated. In another embodiment, the pegs and dials are removed from one another, and an electric circuit energized an LED on the proper peg when the corresponding dial is turned. This provides an indication of the location of the key which is sought.

20 Claims, 11 Drawing Figures

KEY STORAGE AND MONITORING SYSTEM

BACKGROUND AND SUMMARY OF THE INVENTION

This invention relates generally to the storage and monitoring of keys and similar articles used in automobile dealerships and other businesses which must handle and keep track of a large number of articles such as keys and the like.

Co-pending application Ser. No. 680,081, filed Dec. 10, 1984, now U.S. Pat. No. 4,595,922, issued June 17, 1986, describes a key monitoring system which is highly effective in monitoring the locations of keys that are accessible to a number of persons such as automobile salesmen, service personnel, "lot men", and others. This system allows keys to be stored at random locations on a storage board and requires authorized users to enter their personal authorization codes before the location of the desired key is indicated. This system also keeps track of the authorization code of the person who removed the key so that subsequent users can determine who has each missing key.

Although this arrangement functions in a highly satisfactory manner for the most part, it is a microprocessor based system that is somewhat expensive to manufacture. Consequently, a need remains for a simpler system which stores and monitors the keys in an effective manner and yet can be made at a lesser cost than the electronic system. It is the principal goal of the present invention to meet that need.

More specifically, it is an important object of the invention to provide a key storage board which includes a plurality of key storage pegs and a dial indicator for each peg for the entry of the user codes of authorized users who remove the keys. When used properly, the user codes that are entered on the dials provide information as to the identity of the persons who have removed missing keys so that subsequent users seeking the missing keys can determine who is in possession of them.

In accordance with one embodiment of the invention, the dials and the key storage pegs are mounted together on the main storage part of the key board. The pegs and dials are arranged in rows and columns, and each peg is identified by an alphanumeric or other symbol. A list at the top of the board lists the alphanumeric symbols and describes the automobile or other object which corresponds to the key that is stored on each peg. Consequently, the proper key can be quickly located simply by referring to the list. When a key is removed from its peg, the user turns the adjacent dial until it designates his unique authorization code so that subsequent users can read the code from the dial to determine who has each key that is missing from its peg.

It is particular feature of the invention that pegs are constructed in a manner to require the dial to be turned before the key is released. This is accomplished by placing the key chain in a spiral groove on the peg which is normally recessed within the dial. When the dial is turned, the peg turns with it and the key chain is "augered" along the spiral groove to convey it out of the dial recess where it can be reached and removed from the peg. By virtue of this arrangement, users are forced to turn the dials and are thus encouraged to dial in their user codes, and the integrity of the system is enhanced.

In accordance with a second embodiment of the invention, the dials are located remotely from the pegs on the list portion of the key board. Each peg is provided with an LED or other light, and the LED is energized whenever the corresponding dial is turned. Accordingly, an authorized user can locate on the list the vehicle description for the key he is seeking, and he can turn the adjacent dial to light the peg which holds the desired key. This allows the key to be easily located and also encourages users to dial in their codes because they must turn the proper dial to energize the light which indicates the location of the key. Consequently, users are again encouraged to enter their codes before removing a key, and this enhances the integrity and reliability of the system.

The electrical circuit for the system is arranged to energize the proper LED long enough (such as 30 seconds, for example) to allow the user to easily locate the desired key. Then, the LED is deenergized and the system returns to its normal "standby" state where it is in a condition to energize another LED when one of the dials is turned by a subsequent user.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE DRAWINGS

The present invention is directed to a key storage system which serves to store and monitor keys such as the keys for automobiles in the inventory of an automobile dealer. However, the system can also store keys that are handled by parking lots, rental car companies, real estate companies, factories, office buildings and other businesses and institutions which must keep track of a relatively large number of keys. It should also be understood that this system can monitor items other than keys if desired.

Figure 1:
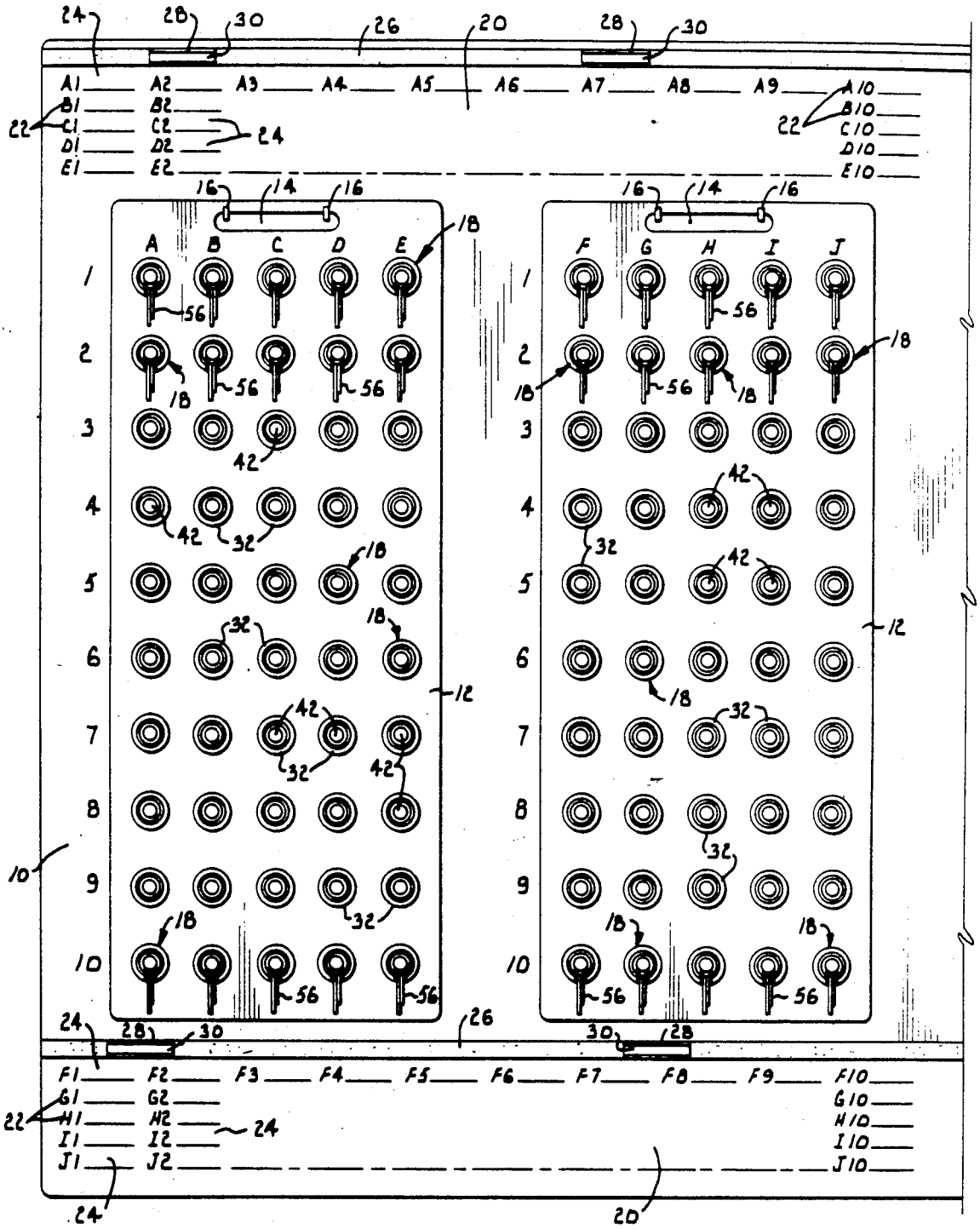
FIG. 1 is a fragmentary front elevational view showing part of a key storage board constructed according to one embodiment of the present invention.

Referring now to the drawings in detail and initially to FIG. 1, numeral 10 designates a wall mounted key board on which a large number of keys can be stored. The key board 10 is a flat panel which can be located at a convenient area in the automobile dealership or other business where salesmen and other authorized personnel have ready access to it. A plurality of detachable key holding panels 12 are mounted side by side on the main storage part of the key board 10. A cutout 14 is formed near the top edge of each panel 12, and the cutout 14 of each panel can be fitted on a pair of hooks 16 which project forwardly from the face of the key board 10. Each panel 12 can be removed from the key board and handled individually simply by lifting it off of the hooks 16. The cutouts 14 are large enough to receive the fingers so that they can serve as handles for the panels 12.

Each of the removable panels 12 is provided on its front face with a plurality of key storage elements which are generally designated by numeral 18. The key storage elements are arranged on each panel 12 in an array formed by a plurality of rows and columns. Although any number of rows and columns can be provided, the drawing illustrates 10 horizontal rows and five vertical columns on each panel 12. A different letter is imprinted on each panel 12 at the head of each column. For example, the first or left most panel 12 on the key board 10 is provided at the head of its columns with the letters A–E. The second panel 12 is provided at the head of its columns with the letters F–J. The key board 10 may hold virtually any number of panels 12, and the additional panels likewise have columns headed by different letters or other identifying symbols. The different rows of key holding elements 18 on each panel are designated by the numerals 1–10. These numerals are imprinted on the face of the key board 10 at locations to align with the successive rows when the panel is suspended on the hooks 16.

One or more printed lists 20 are provided on the front face of the key board 10. Each list 20 may be imprinted on an adhesive backed strip which adheres to the key board. Each list has imprinted on it a plurality of alphanumeric reference characters 22, each followed by a space 24 which contains a written description of the vehicle associated with the key which corresponds to the alphanumeric character adjacent the description. A steel strip 26 extends horizontally across the head of each strip 20. A plurality of magnets 28 are provided and may be applied to the strips 26 and held in place by magnetic attraction. Each magnet 28 receives a removable label 30 which contains a written category description identifying the type of vehicle described in the underlying column on the list 20. For example, if the vehicles which correspond to the alphanumeric characters A2, B2, C2, D2 and E2 are all Cadillac automobiles, the label 30 for the magnet located above these characters would have "Cadillacs" imprinted thereon to indicate that Cadillacs are described in the underlying part of the list. The labels 30 may have additional information such as colors, body styles, years, etc., in order to further categorize the vehicles.

One of the alphanumeric characters 22 corresponds to each of the key holding elements 18, and the space 24 following the alphanumeric character contains a description of the vehicle for the key which is intended to be stored on the corresponding element 18. For example, the "1" key holding element 18 is located on the upper left-hand corner of the first key storage panel 12 where the "A" column intersects with the "1" row. If this element is intended to store the key for a green, two-door, 1984 Cadillac, then the "A1" reference character will contain in its space 24 a description of this vehicle. It should be understood that the lists 20 may be located as desired on the key board 10 and need not necessarily be applied to its top and bottom edge portions. Likewise, the key storage panels can be located as desired on the key board.

Figure 2:
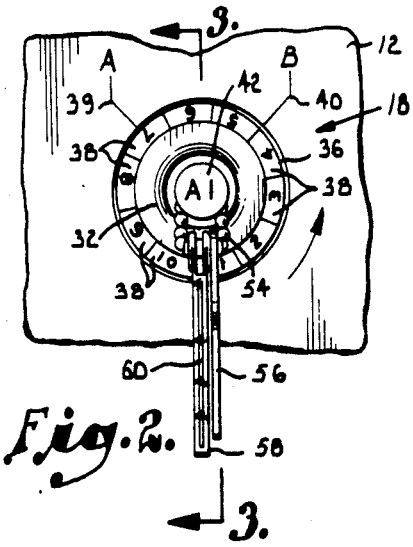
FIG. 2 is a fragmentary front elevational view on an enlarged scale of the dial assembly for the "A1" key.
Figure 3:
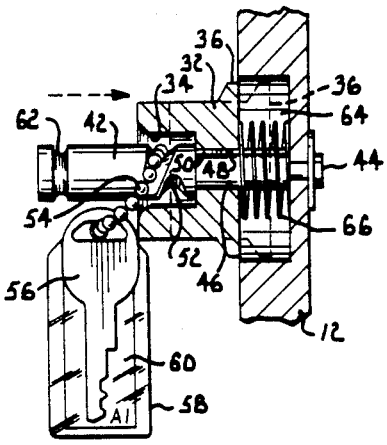
FIG. 3 is a fragmentary sectional view taken generally along line 3—3 of FIG. 2 in the direction of the arrows, with the key secured in its storage position on the peg.
Figure 4:
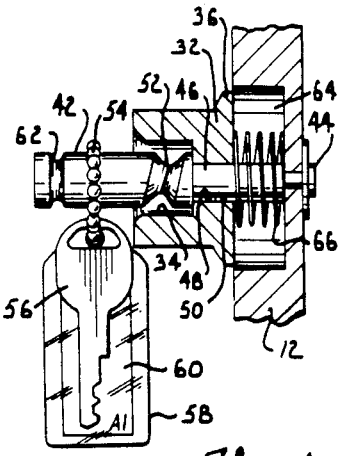
FIG. 4 is a fragmentary sectional view similar to FIG. 3 but showing the key chain conveyed outwardly on the peg to permit removal of the key from its peg.

All of the key storage elements 18 are constructed in the same manner, and their construction is best illustrated in FIGS. 2–4. Each element 18 includes a rotary knob or dial 32 having a recess or cavity 34 formed in its front face. Each dial 32 has on its base a peripheral flange 36 normally located adjacent the front surface of the key holding panel 12. As shown in FIG. 2, the front surface of flange 36 is divided into a plurality of equally sized portions 38 each having a different number imprinted thereon. A pair of indicator marks 39 and 40 are imprinted on the face of each panel 12 adjacent the periphery of each dial 32. Each of the indicator marks 39 is associated with the letter A which is imprinted on panel 12, while the letter B is imprinted adjacent each of the indicator marks 40. When the dial 32 is rotated such that one of the portions 39 is centered on one of the indicator marks 38 or 40, the other indicator mark is aligned with one of the dividing lines between two adjacent portions 38. By this arrangement, only one of the marks 39 and 40 can be aligned at any given time with the center of one of the portions 38.

Each key holding element 18 also includes a peg 42 which is mounted on panel 12 by a rivet 44 or other fastener which permits the peg to rotate axially on the panel. A reduced diameter portion 46 of each peg 42 extends through a cylindrical passage 48 which is formed centrally through the dial 32. A spline 50 connects each peg 42 with the corresponding dial 32 such that the peg and dial rotate together. However, spline 50 allows the dial 32 to slide back and forth axially on the peg.

The shank portion of each peg 42 fits rather closely in cavity 34 and is provided with a spiral groove 52 which is large enough to receive a key chain 54 on which the key 56 is carried. Also carried on the key chain 54 is a key tag 58 having a removable card 60 which is imprinted with a description of the vehicle to which key 56 applies, along with an alphanumeric character (A1, for example) which indicates the position of the key on the key board. The key tag 58 which bears the identifying character A1 is intended to be stored on the "A1" peg 42.

The spiral groove 52 of each peg is normally located in the cavity 34 of knob 32, and the key chain 54 is received in the groove 52 and retained therein by the close fit between the shank of peg 42 and the wall which surrounds recess 34. However, when knob 32 is turned, peg 42 is simultaneously turned, and the augering action provided by the spiral groove 52 conveys the key chain 54 along the groove until it slips out of cavity 34 and groove 52, as shown in FIG. 4. In this position on the key chain, it can be easily removed from peg 42 because the forward end portion of each peg 42 is always accessible. An annular groove 62 is provided in the forward end of each peg 42 to prevent the key chain from inadvertently slipping completely off of the front end of the peg.

A cavity 64 is provided in the front face of panel 12 immediately behind each of the knobs 32. A compression spring 66 encircles portion 46 of peg 42 and is located in cavity 64 with one end acting against the base of cavity 64 and the other end acting against the backside of dial 32. The spring 66 thus continuously urges dial 32 toward the extended position shown in solid lines in FIGS. 3 and 4. In this position of the dial, the base of recess 34 is disposed against the shoulder formed by the reduced diameter portion 46 of peg 42, thus holding the dial on the peg and preventing it from moving outwardly beyond the extended position. Dial 32 can be pushed inwardly into cavity 64 against the force of spring 66 to the retracted position shown in broken lines in FIG. 3. Then, at least a portion of the spiral groove 52 is located out of the recess 34 to permit the key chain 54 to be fitted in the groove when the key is replaced on its peg 42.

In use of the key storage system shown in FIGS. 1–4, the keys are stored on the key storage elements 18 designated by the alphanumeric characters which correspond to those on the lists 20. When the keys are stored on the pegs 42, the key chain of each key is located in the spiral groove 52 which is recessed within the cavity 34 and thus inaccessible.

Each vehicle salesman or other person authorized to have access to the keys is assigned a unique user code, and each authorized user can locate a desired key by first locating the description of the desired automobile on one of the lists 20. In this respect, the labels 30 are helpful in that they indicate the general category of the desired vehicle description. Once the vehicle description is found in one of the spaces 24, the adjacent alphanumeric character 22 is noted, and the authorized user of the system then locates the key storage element 18 which is designated by the same alphanumeric character.

If the desired key is present on the peg 42 of the key holding element 18, it is necessary for the dial 32 to be turned until the key chain 54 is augered out of the spiral groove and thus out of the recess 34 where it is accessible and can be removed from the peg 42. As previously indicated, it is contemplated that each authorized user of the system will be assigned a unique user code which he is instructed to enter on the dial 32 for each key that he removes from the board. For example, if the authorized user's code is "A7", he turns the dial until the numeral 7 on flange 36 of the dial is aligned with the A reference mark 39. This position of the dial is shown in FIG. 2 for the "A1" key.

A subsequent user seeking the "A1" key locates the proper key holding element 18 in the same manner previously described, although now there is no key present because it has been removed and not yet returned by the other user. However, the subsequent user can note that the dial designates the A7 user code, and he can determine in this manner the identity of the person in possession of the key and can locate him to obtain the key if necessary. It is again pointed out that because of the relative locations of the reference marks 39 and 40 for each dial, only one of the marks will be centered on one of the areas 38 at any time, so that there is little risk of confusion between the A and B indicator marks 39 and 40. The provision of two indicator marks is desirable because it doubles the number of available user codes that can be assigned, although two marks are not necessary and only one can be provided if desired.

Although it is not necessary for the dial to be turned to indicate the user code of the particular individual removing the key, he is required to at least turn the dial far enough to convey the key chain 54 out of the spiral groove 52. Since each user is required to turn the dial in order to release the key, he is encouraged to dial in his user code since he must in any event turn the dial.

The return of a key to the key board is accomplished by pushing the appropriate dial 32 inwardly into cavity 64 to the retracted position wherein the spiral groove 52 is exposed. Then, the chain can simply be inserted into the spiral groove and the dial 32 can be released. Spring 66 returns the dial to its extended position, and the groove 52 is then recessed within the dial so that the key cannot be removed until the dial is again rotated.

Figure 5:
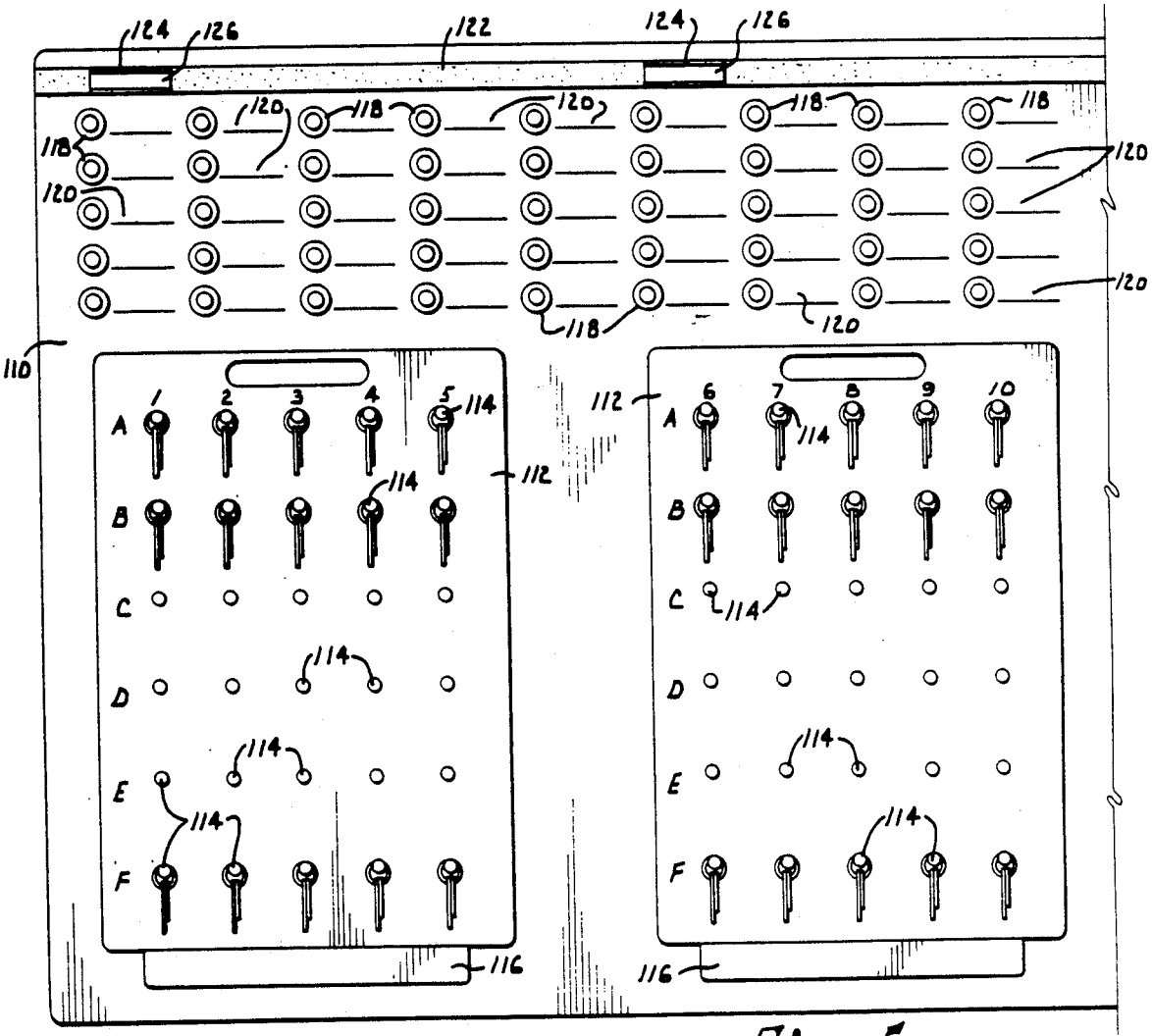
FIG. 5 is a fragmentary front elevational view showing part of a key storage board constructed according to a second embodiment of the invention.

Referring now to FIG. 5, a modified form of the invention includes a flat, wall mounted key board 110. A plurality of key holding panels 112 are mounted side by side on the front face of the key board 110, and each panel 112 carries a plurality of key storage pegs 114 arranged on the panel in a plurality of rows and columns. A numeral is imprinted on panel 112 at the head of each column while a letter is imprinted at the beginning of each row. The panels 112 are plugged into jacks 116 on the face of panel 110, and the jacks 116 provide electrical connection between the panels and key board as well as physical support for the panels.

The removable panels 112 are located on the main storage part of the key board 110 which is separate from the other part of the board which carries a plurality of rotatable dials 118. The dials 118 are shown in the drawings being located along the top edge portion of board 110, although they may be located elsewhere if desired. In any event, there is one dial 118 which corresponds to each of the storage pegs 114. Adjacent to each dial 118 is a space 120 in which a description of the automobile corresponding to the dial is imprinted. Again, a steel strip 122 extends across the top edge portion of the key board and carries a plurality of magnets 124 each having a label 126 which provides information as to the category of the vehicles described in the underlying spaces 120.

Because of the correspondence between each dial 118 and one of the pegs 114, each vehicle which is described on the key board 110 corresponds to one of the pegs 114 which is intended to receive the key for that vehicle. For example, if the "A1" peg is intended to hold the key for a particular vehicle, that vehicle is described in the space 120 adjacent to the dial 118 which corresponds to the "A1" peg. The physical arrangement and ordering of the dials 118 need not correspond to the physical arrangement in ordering of the pegs 114. In other words, the dial corresponding to the A1 storage peg may be located anywhere in the array of dials on the key board, and the dials may be located randomly or in any orderly arrangement that is desired.

Figure 9:
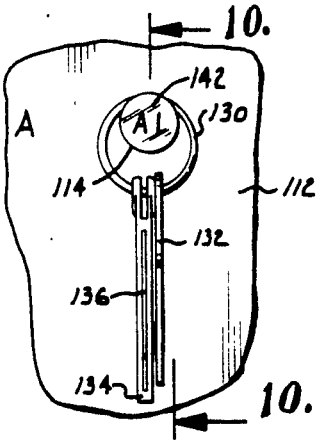
FIG. 9 is a fragmentary front elevational view on an enlarged scale showing the "A1" storage peg mounted on the key board of FIG. 5.
Figure 10:
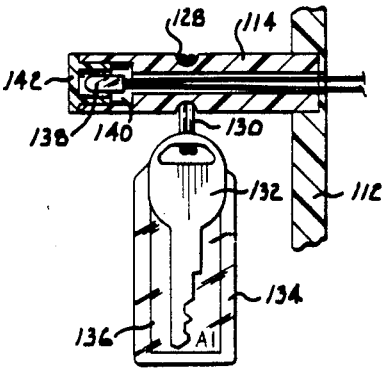
FIG. 10 is a fragmentary sectional view on an enlarged scale taken generally along line 10—10 of FIG. 9 in the direction of the arrows.

The key storage pegs 114 are all constructed in the same manner, and the "A1" peg is illustrated in FIGS. 9–10. The peg 114 is stationary and is fixed at one end to the panel 112. An annular groove 128 is provided in each peg 114 to receive a key ring 30 which holds a key 132. Also carried on the key ring 130 is a key tag 134 having a removable card 136 which contains a description of the corresponding vehicle and is imprinted with the alphanumeric character (A1) used to designate that particular key.

On the outer end of each peg 114, a small light emitting diode (LED) is mounted within a cavity 140. A translucent lens 142 is secured on the outer end of the peg so that the LED 138 is visible through the lens 142 when the LED is energized. The alphanumeric character which designates the peg 114 is imprinted on the outer surface of the lens 142, as shown in FIG. 9. The wiring for the LED 138 extends through the center of the peg and is included in the electrical circuit that will subsequently be described.

Figure 6:
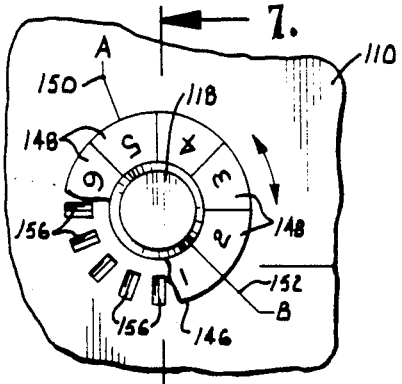
FIG. 6 is a fragmentary front elevational view on an enlarged scale showing one of the dials mounted on the key board of FIG. 5, with a portion of the dial broken away for illustrative purposes.
Figure 7:
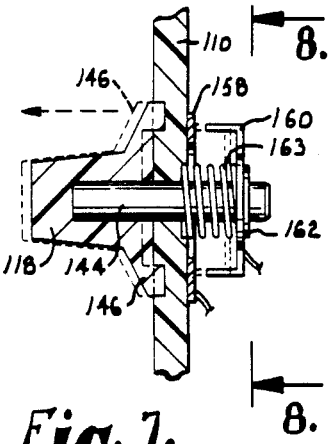
FIG. 7 is a fragmentary sectional view taken generally along line 7—7 of FIG. 6 in the direction of the arrows, with the broken lines illustrating the reciprocation of the dial when it is turned.
Figure 8:
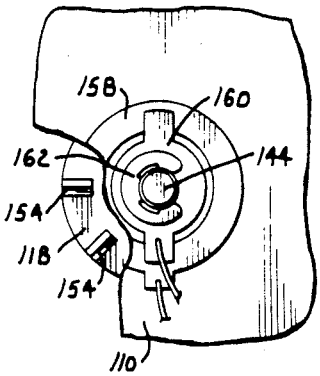
FIG. 8 is a fragmentary rear elevational view taken generally along line 8—8 of FIG. 7 in the direction of the arrows, with a portion broken away for illustrative purposes.

The dials 118 are all constructed in the same manner, and the details of construction are shown in FIGS. 6–8. Each dial 118 is mounted on a pin 144 which extends through the key board 110 and is rotatable about its axis. A peripheral flange 146 is formed on the base of each dial 118 and is divided into a plurality of equally sized areas 148 each having a different identifying numeral imprinted thereon. A pair of indicator marks 150 and 152 are imprinted on the surface of the key board 110 adjacent to the periphery of each dial 118. The letter A is imprinted adjacent to each mark 150, while the letter B is imprinted next to each mark 152. The marks 150 and 152 are located such that when either mark is aligned with the center of one of the areas 148, the other mark is aligned with one of the divider lines between two adjacent areas 148.

On its underside, the peripheral flange 146 of each knob 118 carries a plurality of tapered fingers 154 which are spaced equidistantly around the flange. Each finger 154 tapers to an edge as it extends away from the flange 146. As shown in FIG. 6, the key board 110 is provided behind each dial with a plurality of tapered grooves 156 which are complemental to the fingers 154 in size and shape. The grooves 156 are twice as many in number as the fingers 154 and are located to receive the fingers as the dial is rotated. Each increment of rotation of the dial results in the fingers 154 entering and seating in different of the grooves 156. Each time the dial is turned through an additional rotational increment, a different one of the marks 150 and 152 is aligned at the center of one of the peripheral areas 148 on flange 146.

A stationary electrical contact 158 in the form of a flat ring is secured to the back side of the key board 110 behind each of the dials 118. A moving contact 160 is mounted on each of the pins 144 and is retained thereon by a retaining clip 162. A compression spring 163 holds contact 160 against the retaining clip 162. When the rotational position of knob 118 is such that fingers 154 are seated in grooves 156, the movable contact 160 is spaced behind and out of contact with the fixed contact 158. However, when the knob 118 is rotated, its fingers 154 slide out of the grooves 156 and are held on the front surface of the key board 110 as the knob is being turned through an increment of rotation. When the fingers 154 are riding on the surface of the key board, pin 144 pulls the movable contact 160 forwardly until it contacts the fixed contact 158. Consequently, contacts 158 and 160 are normally open but are closed at least temporarily each time knob 118 is turned.

Figure 11:
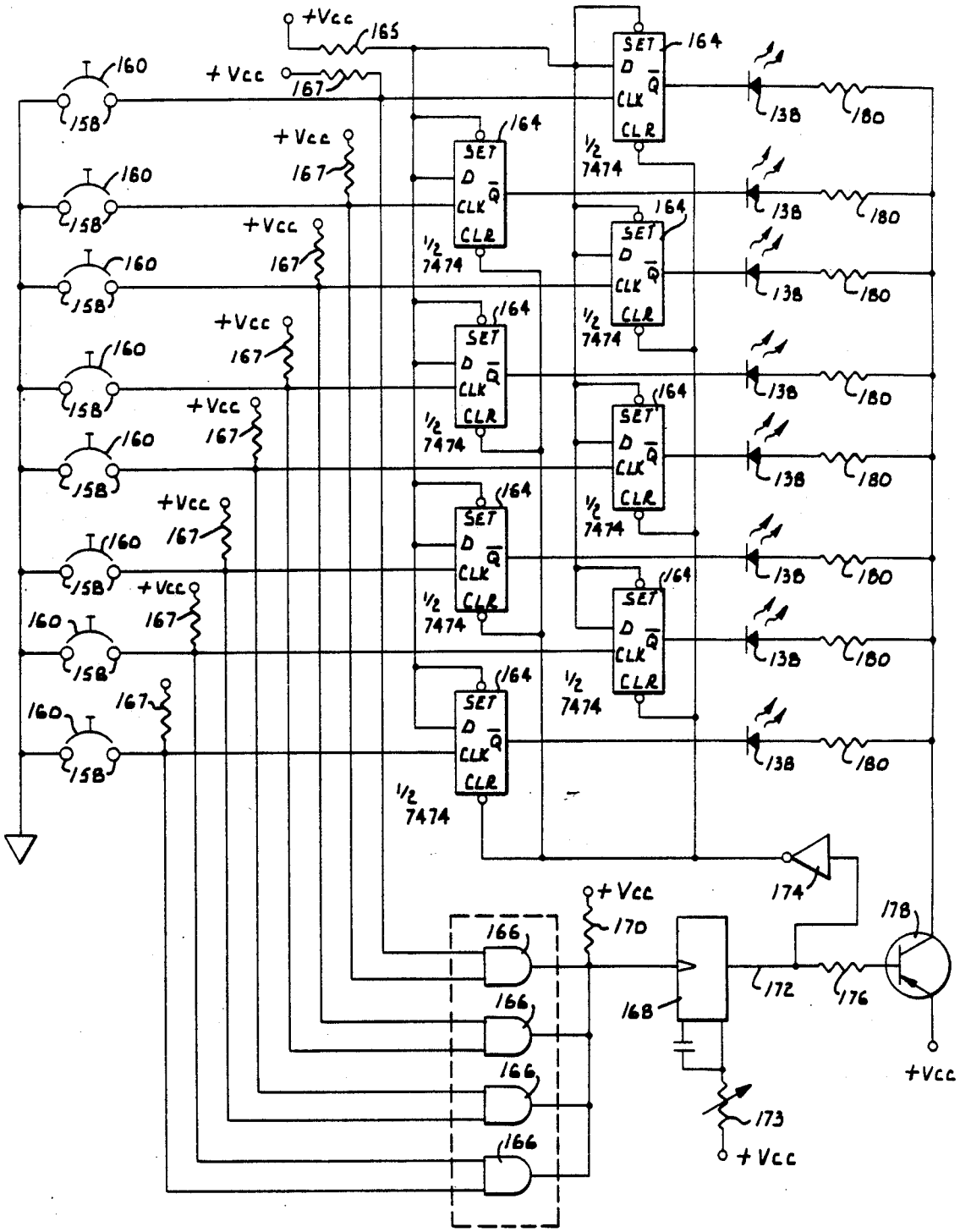
FIG. 11 is a schematic diagram of the electrical circuitry for the key board shown in FIG. 5.

The contacts 158 and 160 of each dial 118 are included in the electrical circuit shown schematically in FIG. 11. One side of each set of contacts is grounded, while the other side connects with the clock input of a D-type flip-flop 164. A positive voltage is applied through resistor 165 to the D input of each flip-flop 164 and to its set input. The clock input of each flip-flop normally receives a positive voltage applied through a resistor 167. However, when one set of the contacts 158 and 160 close, the clock input of the corresponding flip-flop is pulled low due to the ground connection established through the closed contacts.

A bank of open collector AND gates 166 have their inputs connected with the clock input lines of the flip-flops 164. Consequently, both inputs of each AND gate 166 are normally high, but one of the inputs to one of the AND gates is pulled to the low state whenever one set of the contacts 158 and 160 are closed. The output lines of the AND gates 166 are tied together and are applied to a retriggerable one shot circuit 168. A positive voltage is normally applied to the input of circuit 168 through a resistor 170. Since both inputs to each AND gate 166 are normally high, the output line of each AND gate is normally in a high state, and a high input signal is thus normally applied to the one shot circuit 168 to normally provide a high signal on its output line 172. The output line 172 connects through an inverter 174 with the clear input of each flip-flop 164. A potentiometer 173 permits adjustment of the duration of the probe which appears on line 172 when its input changes state.

Line 172 also connects through resistor 176 with the base of a transistor 178 having a positive voltage applied to its emitter. The collector of transistor 178 connects through resistors 180 with the LED's 138 which are located on the key storage pegs 114. The LED's 138 are arranged in parallel and are connected with the $\overline{Q}$ output pins of the corresponding flip-flops 164.

It should be pointed out that FIG. 11 is simplified for purposes of illustration and shows only eight sets of contacts 158 and 160. In actual practice, the circuit is identical but includes more components because one set of contacts 158 and 160 are required for each dial 118 that is provided on the key board 110.

In use of the system shown in FIGS. 5–11, the key for a desired automobile can be located by finding its description in one of the spaces 120. Again, the category headings 126 are helpful in facilitating location of the proper automobile description. Once the automobile description is located, the adjacent dial 118 is turned until it designates the user code of the authorized user of the system. For example, if the user's personal code is A5, the dial 118 for the desired key is turned to the position shown in FIG. 6 where the A indicator mark 150 is centered on the area 148 which bears the numeral 5.

When the knob 118 is turned, the LED 138 of the corresponding storage peg 114 is energized to provide a visual indication of the location of the desired key. The user can then simply remove the key from the storage peg. Since the dial 118 designates the user code of the person who has removed the key, subsequent users are able to identify the person in possession of any keys that are missing from the key board.

When one of the dials 118 is turned, its contacts 158 and 160 close and cause the LED 138 corresponding to the dial to be illuminated by the circuit shown in FIG. 11. Closing of one set of contacts 158 and 160 pulls the clock line of the corresponding flip-flop 164 from its normally high state to a temporary low state. The clock input line goes to a high state again as soon as the fingers 154 enter the grooves 156 again, and a high signal is then applied to the clock line. The clock lines for the remaining flip-flop 164 remain in a high state at all times because their contacts 158 and 160 remain open.

Closing of the contacts 158 and 160 also pull one of the inputs to one of the AND gates 166 to a low state, and this results in a low output signal from that AND gate. The low output state of the AND gate pulls the input signal to the one shot circuit 168 to a low state also, and a low square wave pulse having a preselected duration is then provided on the output line 172. The low signal on line 172 is applied to the base of transistor 178 to make the transistor conductive, thereby making the positive voltage available to the LED's 138.

The low pulse on line 172 is also applied to inverter 174 and then as a high pulse to the clear lines of the flip-flops 164. Since the flip-flops are edge triggered, they are active only in response to positive going pulses on their clock lines. The only flip flop having a positive going pulse applied to its clock line is that associated with the contacts 158 and 160 of the dial which has been turned. Consequently, the $\overline{Q}$ pin of only this flip-flop is pulled to the low state, and the $\overline{Q}$ pins of the remaining flip-flops remain in the high state. Therefore, only the LED 138 which is tied to the $\overline{Q}$ pin of the active flip-flop is energized, and this is the LED which corresponds to the dial that has been turned.

At the end of the low pulse, the output line 172 of the one shot circuit 168 reverts to its normally high state and effects the nonconductive state of transistor 178. The clear pins of all of the flip-flops then go low, and this results in the $\overline{Q}$ pins of all flip-flops being in a high state. The LED 138 which was previously energized is then extinguished, and the circuit is in its normal standby condition ready to energize another LED 138 when the corresponding dial is turned.

In this manner, turning of any of the dials 118 causes the LED in the corresponding peg 114 to illuminate, thereby signaling the location of the key which is being sought. Although the user need not turn the dial until his personal authorization code is entered, he is encouraged to do so because he must turn the dial in order to locate the desired key and he might just as well dial in his user code since he must turn the dial in any event.

The duration of energization of the LED should be long enough to permit an authorized user to locate the proper key. It is contemplated that the LED will remain energized for approximately 30 seconds, although other time periods are possible.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. Apparatus for storing and monitoring articles such as keys to be accessed by a plurality of authorized users each assigned a different user code, said apparatus comprising:

a storage board for receiving and holding the articles;

a plurality of storage pegs arranged on said storage board in a preselected array, each peg corresponding to a different one of the articles and each peg being adapted to receive and hold the article to which the peg corresponds;

a plurality of user code indicator members on said board each corresponding to a different storage peg and each being supported on the storage board for movement among a plurality of different positions respectively designating the different user codes assigned to the authorized users;

whereby when a particular article is to be removed from its peg by an authorized user, the indicator member corresponding to the peg for said particular article can be moved to the position thereof which designates the user code assigned to said authorized user to inform subsequent users of the identity of the user in possession of said particular article.

2. Apparatus as set forth in claim 1, wherein each of said indicator members comprises a rotary dial supported on said board for rotating movement among said different positions.

3. Apparatus as set forth in claim 2, including:

a peripheral portion of each dial having imprinted thereon a plurality of reference characters; and at least one indicator mark on said board adjacent said peripheral portion of each dial for alignment with the reference characters to provide a designation of the user code for each different position of the dial.

4. Apparatus as set forth in claim 1, including means for releasing each article from its peg only when the indicator member corresponding to the peg is moved from one position to another position.

5. Apparatus as set forth in claim 1, wherein:

said user code indicator members each comprises a rotary dial supported on said board for rotation among said different positions;

said pegs are each connected with the corresponding dial for rotation therewith; and each peg includes means for preventing removal of the article thereon unless the corresponding dial is rotated.

6. Apparatus as set forth in claim 5, wherein said retaining means comprises:

a spiral groove in each peg for receiving the article, said groove having a portion recessed within said dial and terminating in an outer end portion disposed at an accessible location, whereby upon turning of said dial, the corresponding peg turns to convey the article thereon along said spiral groove from said recessed portion thereof to said outer end portion.

7. Apparatus as set forth in claim 6, including:

means for mounting each dial on the board for movement along the axis of the corresponding peg between an extended position wherein said portion of the spiral groove is recessed within said dial and a retracted position wherein said portion of the groove is accessible to receive the article; and yieldable means for urging each dial toward the extended position thereof.

8. Apparatus as set forth in claim 1, including:

a light associated with each peg; and means for energizing the light associate with each peg when the indicator member corresponding to the peg is moved.

9. Apparatus as set forth in claim 8, including means for deenergizing each light after it has been energized for a predetermined time period.

10. Apparatus as set forth in claim 1, including:

a light on each peg;

a normally interrupted electric circuit for each light energizing the latter when completed; and means for completing each circuit for a predetermined period when the indicator member corresponding to the light for the circuit is moved, whereby movement of any indicator member effects energization of the light on the corresponding peg for said predetermined time period.

11. Apparatus as set forth in claim 10, wherein said completing means for each circuit includes a set of normally open contacts in each circuit which close to complete the circuit when the indicator member corresponding to the light for the circuit is moved.

12. Apparatus for storing and monitoring keys accessible to a plurality of authorized users each assigned a different user code, said apparatus comprising:

a keyboard;

a plurality of pegs projecting from said keyboard, each peg corresponding to a different key which is to be stored on the peg when the key is not in use; and a dial adjacent each peg, each dial being supported on said keyboard for rotation among a plurality of different rotative positions each designating a different user code to permit the dial adjacent each peg from which a key is to be removed to be rotated to the position designating the user code of the authorized user who removes said key, thereby identifying said authorized user to subsequent authorized users.

13. Apparatus as set forth in claim 12, including means for retaining each key on its peg until the dial adjacent the peg is rotated.

14. Apparatus in claim 12, including:

means for mounting each peg on the adjacent dial for rotation therewith;

a spiral groove in each peg for receiving the key stored in the peg;

means for mounting each dial for axial movement on the corresponding peg between an extended position and a retracted position;

a cavity in each dial in which said spiral groove of the corresponding peg is enclosed in the extended position of the dial, each groove being displaced from the cavity at an accessible location when the corresponding dial is in its retracted position; and yieldable means for urging each dial toward its extended position, whereby each dial can be moved to the retracted position to permit the key to be received in the groove of the corresponding peg with the key being coveyed along the groove and out of the cavity upon rotation of the corresponding dial.

15. Apparatus as set forth in claim 12, including:

a peripheral port in of each dial divided into a plurality of different areas each having an associated reference character imprinted thereon; and at least one indicator mark on the keyboard adjacent the peripheral portion of each dial for alignment with said different areas of the dial to designate the user code for each different rotational position of the dial.

16. Apparatus as set forth in claim 15, including a second indicator mark on the keyboard adjacent the peripheral portion of each dial and offset from said one mark, said one mark and said second mark for each dial being located such that when either mark is aligned with one of said areas, the other mark is located between a pair of said areas.

17. Apparatus for storing and monitoring keys accessible to a plurality of authorized users each assigned a different user code, said apparatus comprising:

a keyboard;

a plurality of storage pegs projecting from said keyboard and arranged in an array on a first portion of the keyboard, each peg corresponding to a different key which is to be stored on the peg when not in use;

a plurality of rotary dials arranged in an array on a second portion of the keyboard offset from said first portion, each dial corresponding to a different one of said pegs and each dial being supported on the keyboard for rotation among a plurality of different rotative positions each designating a different user code;

a light adjacent each peg; and means for energizing each light when the dial corresponding to the peg for the light is turned, whereby each authorized user intending to locate and remove particular key can turn the corresponding dial to the rotative position designating the user code assigned to said authorized user to energize the light corresponding to said particular key and to inform subsequent users of the user code of said authorized user.

18. Apparatus as set forth in claim 17, including means for deenergizing each light after same has been energized for a predetermined time period.

19. Apparatus as set forth in claim 17, wherein said energizing means comprises:

a normally interrupted electric circuit for each light energizing the latter when complete;

a set of normally open electrical contacts in each circuit completing the circuit when closed;

means for temporarily closing each set of contacts upon movement of the dial corresponding to the peg for the light of the circuit containing the contacts; and means for maintaining each light energized for a predetermined time period following closure of the corresponding set of contacts.

20. Apparatus as set forth in claim 19, wherein each set of contacts includes:

a stationary contact on said keyboard adjacent the corresponding dial; and a moving contact carried on the corresponding dial, said moving contact normally being displaced from the stationary contact but contacing same when the dial is turned.

* * * * *